US005083134A

United States Patent [19]

Saitou et al.

[11] Patent Number: 5,083,134

[45] Date of Patent: Jan. 21, 1992

[54] ANTENNA DEVICE FOR AN AUTOMOBILE

[75] Inventors: Toshihiko Saitou, Ebina; Takashi Yamashita, Sagamihara; Kenichi Ishii, Aichi; Masanobu Ogawa; Shinya Shibata, both of Kanagawa; Kenji Oda; Masaharu Kume, both of Yokohama, all of Japan

[73] Assignee: Asahi Glass Company Ltd., Tokyo, Japan

[21] Appl. No.: 379,345

[22] Filed: Jul. 13, 1989

[30] Foreign Application Priority Data

| | | | |
|---|---|---|---|
| Jul. 14, 1988 | [JP] | Japan | 63-173983 |
| Sep. 6, 1988 | [JP] | Japan | 63-221313 |
| Mar. 14, 1989 | [JP] | Japan | 1-59789 |

[51] Int. Cl.[5] ..... H01Q 1/32

[52] U.S. Cl. ..... 343/713; 343/704

[58] Field of Search ..... 343/713, 711, 712, 704

[56] References Cited

U.S. PATENT DOCUMENTS

| | | | |
|---|---|---|---|
| 4,063,247 | 12/1977 | Sakurai et al. | 343/713 |
| 4,086,594 | 4/1978 | Kropielnicki et al. | 343/704 |
| 4,439,771 | 3/1984 | Kume et al. | 343/713 |
| 4,491,844 | 1/1985 | Tsuchie et al. | 343/704 |
| 4,791,426 | 12/1988 | Lindenmeier et al. | 343/713 |
| 4,823,140 | 4/1989 | Shibata et al. | 343/713 |

FOREIGN PATENT DOCUMENTS

| | | | |
|---|---|---|---|
| 0065263 | 11/1982 | European Pat. Off. . | |
| 0155647 | 2/1987 | European Pat. Off. . | |
| 2336320 | 2/1975 | Fed. Rep. of Germany . | |
| 3405114 | 8/1985 | Fed. Rep. of Germany . | |
| 57-125501 | 8/1982 | Japan | 343/713 |

OTHER PUBLICATIONS

Rundfunktechnische Mitteilungen, vol. 31, No. 4, Jul./Aug. 1987, pp. 161-167, Norderstedt, DE: J. Hopf et al., "Aktive Scheibenantennen fur den Rundfunkempfang im Auto unter besonderer Berucksichtigung von Antennen-Diversity", pp. 165, 166, paragraph 2.2.3.

*Primary Examiner*—Michael C. Wimer
*Assistant Examiner*—Hoanganh Le
*Attorney, Agent, or Firm*—Oblon, Spivak, McClelland, Maier & Neustadt

[57] ABSTRACT

An antenna device for an automobile comprises an electric heating type defogger having heating strips and a bus bar for feeding a current to the heating strips and an antenna conductor having antenna strips arranged to form a pattern, which are fitted on the rear window glass fitted to a rear window opening formed in an automobile, wherein the defogger and the antenna conductor are spaced apart from each other with a predetermined small space in a capacitive coupling relation so a reactance circuit is connected to the defogger to effect anti-resonance between the defogger and the rear window opening of the body of the automobile at the central frequency in terms of logarithmic scale of a broadcast frequency band region; a quality factor value is determined by the inductance of a choke coil in the reactance circuit and the stray capacitance between the defogger and the rear window opening of the body of the automobile so that the ratio of an input impedance to a receiver to the impedance of the antenna conductor viewed from the side of a power feeding terminal becomes 1; and a matching circuit is inserted between the power feeding terminal of the antenna conductor and the receiver so that the sum of the impedance of the antenna conductor viewed from the side of the input terminal of the receiver and the functional part as an antenna in the rear window glass exhibits a little capacitive reactance in a broadcast frequency band region.

9 Claims, 12 Drawing Sheets

ANTENNA DEVICE FOR AN AUTOMOBILE

BACKGROUND OF THE INVENTION

The present invention relates to an antenna device for an automobile for suppressing generation of noises.

As an antenna device for receiving radio waves for an automobile, there has been known such ones having antenna conductors for AM broadcasts, FM broadcasts or AM/FM broadcasts which are provided on the surface or inside the rear windowglass of the automobiles instead of rod antenna. The antennas provided on or in the rear window glass of the automobiles, having no part projecting from the car body unlike the rod antenna or the lid antenna, have many advantages that they are harmless to persons, are not easily broken, do not become rusty, hence there is no change of performance, and provide excellent appearance for the automobiles.

In such type of antenna devices, it is possible to obtain desired performance, i.e. increasing a gain of antenna by suitably designing the pattern of an antenna conductor or antenna conductors provided on or in a glass plate. However, the surface area of the glass plate is not sufficiently large when the antenna device is installed in a window glass for an automobile. Accordingly, the distance between the antenna conductors and the body of an automobile can not be sufficiently large, whereby a leak current from the antenna conductor is large and a gain of antenna becomes insufficient.

In case of the antenna device to be installed in or on the rear window glass of an automobile, an electric heating type defogger for preventing the rear window glass from being cloudy is provided together with the antenna conductor formed in a predetermined pattern. In particular, when the antenna conductor is placed reclose to a heater, a current in the antenna conductor leaks to the body of the automobile through the power feeding part of the electric heating type defogger thereby resulting in a loss of the gain. In order to eliminate the loss of gain, there has been proposed to attach a choke coil to a suitable position of a power feeding point of the electric heating type defogger. However, there is a tendency of reducing the antenna gain because the choke coil has not a sufficient high frequency current preventing function when the choke coil is used for an antenna device for an automobile.

In a conventional antenna device, there was practiced to insert a pre-amplifier 331 at a suitable position of a power feeding line between the power feeding terminal 311 of antenna conductors 306 and a radio wave receiver 312 in order to compensate a loss of antenna gain as shown in FIG. 22. However, there occurred cross modulation in a strong electric field due to the presence of the pre-amplifier to thereby increase a noise level. Further, since it was necessary to connect the pre amplifier in addition to the radio wave receiver in the above-mentioned system, the manufacturing cost is increased. Furthermore, the pre-amplifier to be disposed near the antenna device fairly restricts the condition of designing an automobile, e.g. in assuring a space for the pre-amplifier. Accordingly, it has been expected to develop an antenna device for an automobile capable of obtaining a high gain and reducing noises without the necessity of the pre-amplifier.

SUMMARY OF THE INVENTION

It is an object of the present invention to provide an antenna device for an automobile capable of obtaining a high gain and reducing noises without the necessity of providing an expensive pre-amplifier.

In accordance with the present invention, there is provided an antenna device for an automobile comprising an electric heating type defogger having heating strips and a bus bar for feeding a current to the heating strips and an antenna conductor having at least one antenna strip arranged to form a pattern, the defogger and the antenna conductor being in or on the rear window glass fitted to a rear window opening formed in an automobile, characterized in that the defogger and the antenna conductor are spaced apart from each other with a predetermined small space in a capacitive coupling relation so that a high frequency current is caused to flow but a direct current is not caused to flow between them; a reactance circuit is connected to the defogger to effect anti resonance between the defogger and the rear window opening of the automobile at the central frequency in a predetermined broadcast frequency band region; a quality factor value is determined by the inductance of a choke coil in the reactance circuit and the stray capacitance between the defogger and the rear window opening of automobile so that the ratio of an input impedance to a receiver to the impedance of the antenna conductor viewed from the side of a power feeding terminal becomes 1; and a matching circuit is inserted between the power feeding terminal of the antenna conductor and the receiver so that the sum of the impedance of the antenna conductor viewed from the side of the input terminal of the receiver and the functional part as an antenna in the rear window glass exhibits a capacitive reactance in a predetermined broadcast frequency band region.

In the above-mentioned invention, it is most desirable that a choke coil is used for the reactance circuit connected to the defogger, and an anti-resonance frequency resulted by the inductance of the coil and the stray capacitance between the coil and the rear window opening of automobile is determined to be the center of a predetermined broadcast frequency band region, for instance, AM or FM band region.

In the above-mentioned invention, it is also most desirable that the matching circuit inserted between the power feeding terminal of the antenna conductor and the receiver is constituted by a combination of one or more coils, capacitors and resistors wherein the impedance of the matching circuit is substantially constant in the entire region of a broadcast frequency band region, and the sum of the impedance of the antenna conductor viewed from the input terminal of the receiver, the functional part as an antenna in the rear window glass and a part of an antenna feeder line in a broadcast frequency band region exhibits a little capacitive reactance.

In accordance with the present invention, there is provided an antenna device for an automobile comprising an electric heating type defogger having heating strips and a bus bar for feeding a current to the heating strips and an antenna conductor having at least one antenna strip arranged to form a pattern, the defogger and the antenna conductor being in or on the rear window glass fitted to a rear window opening formed in an automobile, characterized in that the defogger and the antenna conductor are spaced apart from each other with a predetermined small space in a capacitive coupling relation so that a high frequency current is caused to flow but a direct current is not caused to flow between them; a reactance circuit is connected to the defogger to effect anti-resonance between the defogger and the rear window opening of the automobile at the central frequency in a broadcast frequency band region; and a reactance two terminal network circuit is connected between a power feeding point for the antenna conductor and a radio wave receiver wherein the impedance of the reactance two-terminal network circuit is of a nature of inductive reactance and has a constant value in the entire area of FM radio carrier wave frequency.

The feature in construction of the above-mentioned invention is that the absolute value of the impedance of the reactance two-terminal network circuit is in a range of 70 Ω–130 Ω in the entire region of FM radio carrier wave frequency, and the phase angle is in a range of +65°–+85°.

Further, the feature in construction of the invention is that the length of the rear window of the automobile in the horizontal direction is at least 1.7 times as the length of the same in the longitudinal direction.

In accordance with the present invention, there is provided an antenna device for an automobile comprising an electric heating type defogger having heating strips and a bus bar for feeding a current to the heating strips and an antenna conductor having at least one antenna strip arranged to form a pattern, the defogger and the antenna conductor being in or on the rear window glass fitted to a rear window opening formed in an automobile, characterized in that the defogger and the antenna conductor are spaced apart from each other with a predetermined small space in a capacitive coupling relation so that a high frequency current is caused to flow but a direct current is not caused to flow between them; a reactance circuit is connected to a bus bar of the defogger and a d.c. power source for the defogger so that anti-resonance is effected, at the band region on a side of the central frequency in terms of a logarithmic scale of each FM or AM broadcast frequency band regions, by the impedance of the reactance circuit and the impedances of electric static capacitance, viewed from the connecting part of lead wires of the bus bar, in the antenna conductor, the defogger and the body of the automobile, wherein a quality factor value for the AM broadcast frequency band region is determined to be $Q \leqq 1.2$ and a quality factor value for the FM broadcast frequency band region is to be $Q \leqq 2.4$ so that the resonance characteristic of the quality factor for effecting the anti-resonance becomes relatively flat; and a matching circuit is inserted between the power feeding point of the antenna conductor and a receiver so that resonance is effected, at the band region of the other side of the central frequency of each of the FM or AM broadcast frequency band regions, by the impedance of the matching circuit and the input impedance of the receiver and the impedance of the antenna conductor viewed from the matching circuit, wherein a quality factor for the AM broadcast frequency band region is determined to be $Q \leqq 1.2$ and a quality factor for the FM broadcast frequency band region is to be $Q \leqq 2.4$ so that the resonance characteristic of the quality factor for effecting the resonance becomes relatively flat.

DETAILED DESCRIPTION OF THE INVENTION

In the following, preferred embodiments of the present invention will be described with reference to the drawings.

Figure 1:
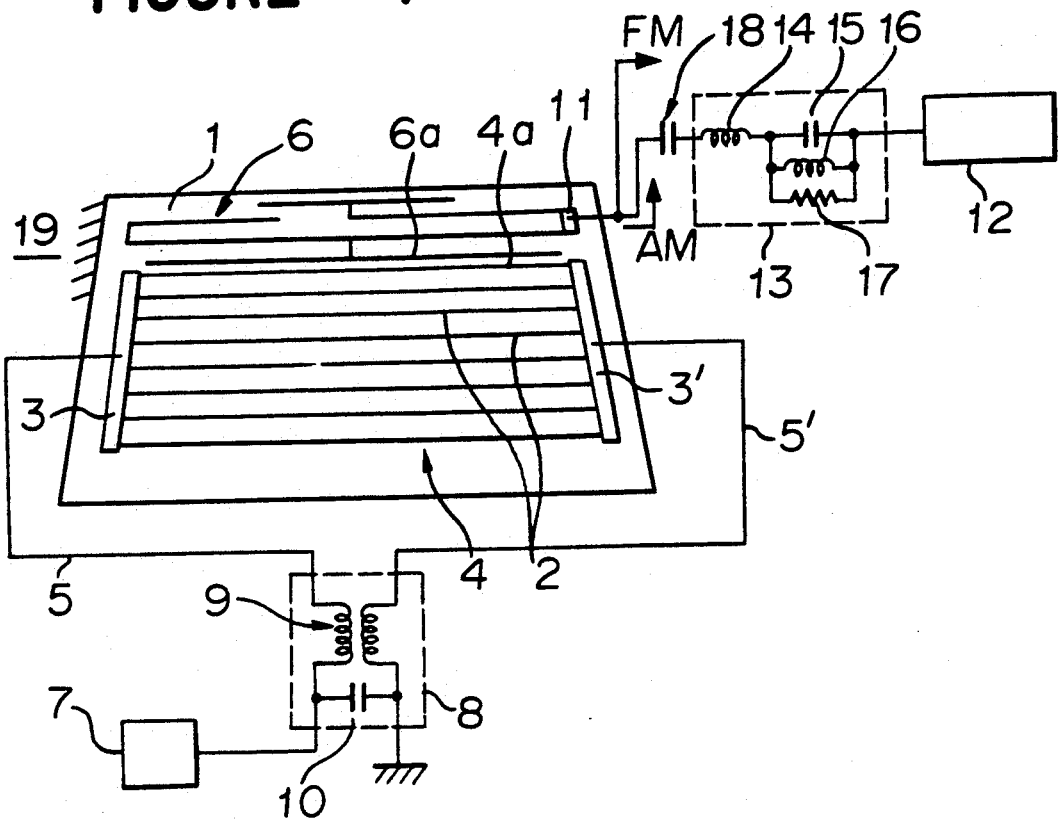
FIGS. 1, 2, 4 and 5 are respectively diagrams showing embodiments of the antenna device for an automobile according to the present invention.
Figure 8:
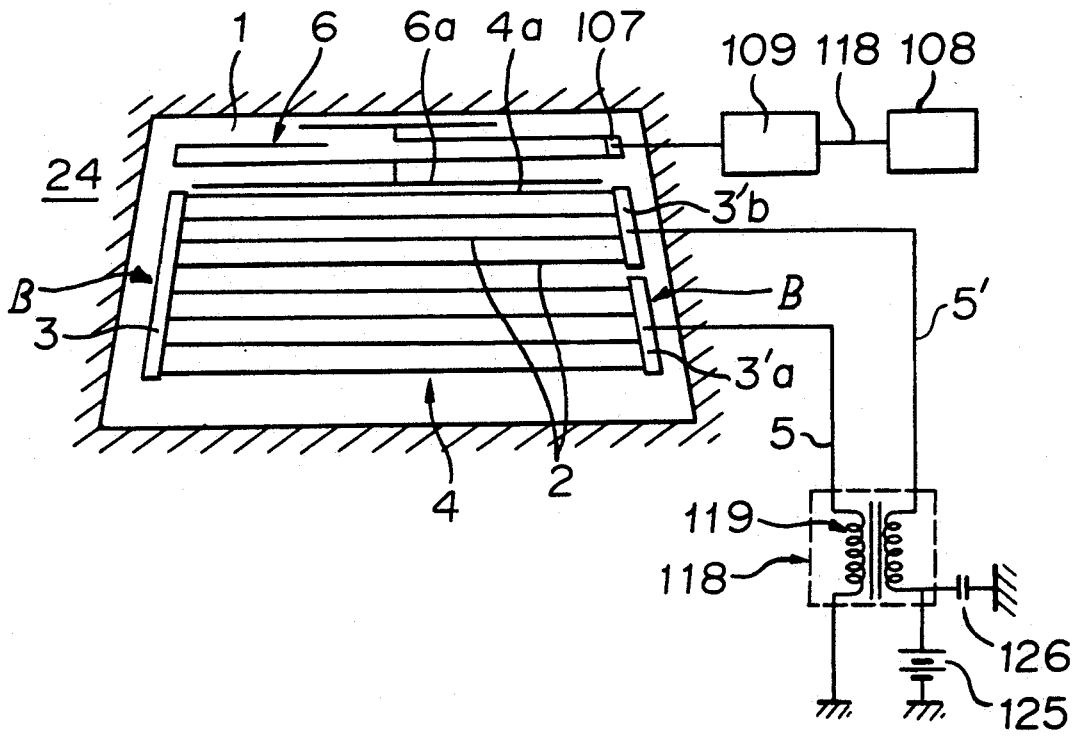
FIG. 8 is a diagram showing another embodiment of the antenna device according to the present invention.

In FIGS. 1 and 8, a reference numeral 1 designates a transparent glass plate to be fitted to the rear window opening formed in an automobile wherein an electric heating type defogger 4 comprising a number of heater strips 2 and bus bars 3, 3' opposing at both ends of the heater strips 2 is provided in a portion to be heated in the inside surface of the glass plate 1. Lead wires 5, 5' are respectively connected to the bus bars of the defogger 4.

Figure 2:
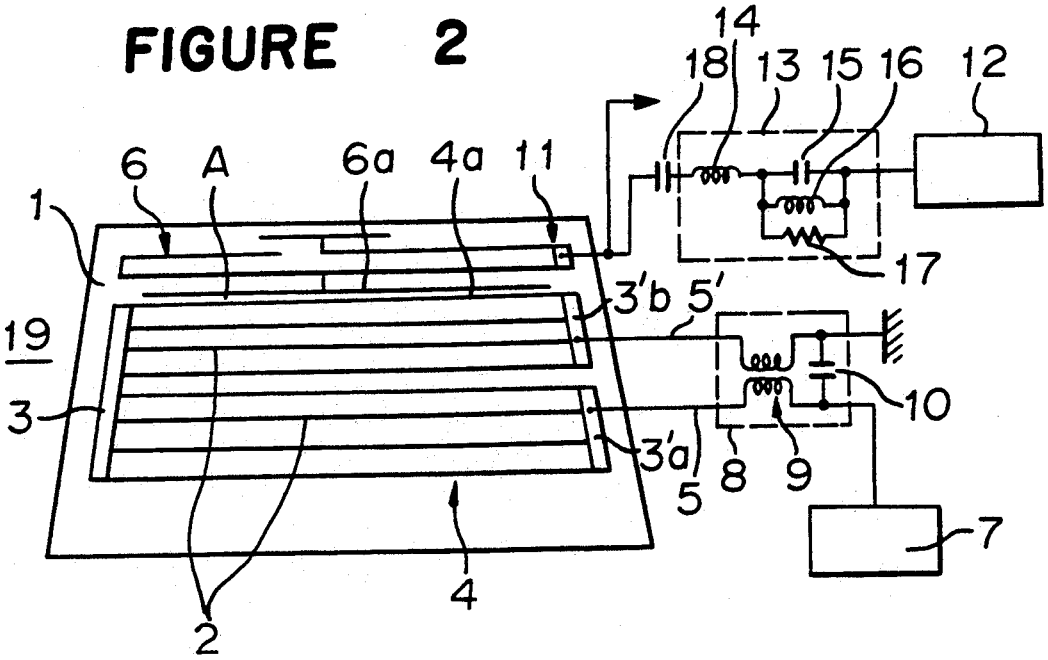

FIG. 2 shows an example of the defogger 4 wherein one of the opposing bus bars 3, 3' is vertically separated at a desired position into two portions, i.e. a lower bus bar 3'a and an upper bus bar 3'b. The lower bus bar 3'a connected to a power source 7 through the lead wire 5 and the upper bus bar 3'b is connected to the ground through the lead wire 5' so that a current flows through the lower bus bar 3'a, the heater strips 2, the bus bar 3, the heater strips 2 and the upper bus bar 3'b. The defogger as shown in the drawing is an electric heating type defogger formed by a printing method wherein a number of heater strips having a wire width of 0.5 mm–2 mm are printed, by using a current conductive silver paste in the lateral direction of a glass plate in parallel to each other with intervals of 2 cm–4 cm, followed by baking the silver paste.

A numeral 6 designates an antenna conductor for AM/FM radio waves provided at the upper portion of the defogger in a glass plate 1 for the rear window of an automobile. A part 6a of the antenna conductor 6 and a part 4a of the defogger 4 are closely positioned with a predetermined space in a capacitive coupling relation so that a high frequency current is caused to flow but a direct current is not caused to flow between them. For instance, the antenna conductor part 6a and the defogger part 4a are spaced apart with a distance of about 1 mm–0 mm. Due to the capacitive coupling between the antenna conductor 6 and the defogger 4, the defogger 6 functions as if it is a part of the antenna conductor. Particularly, the defogger 4 functions as a part of the antenna device to AM frequency band regions for broadcasting, and the effective length of the antenna device for the AM band regions is elongated to increase sensitivity to be capable of receiving radio waves in a wide range.

As described above, in order to connect the defogger 4 and the antenna conductor 6 in a capacitive coupling relation at at least their small portion, it is desirable to form the defogger 4 and the antenna conductor 6 on the same plane of the rear window glass, normally on the side of the cabin of the automobile. A patterned arrangement of an antenna conductor 6 or antenna conductors 6 can be selected as desired so as to obtain the optimum performance as an antenna device for AM band radio wave broadcast, FM band radio wave broadcast, AM/FM band radio wave broadcast or television broadcast depending on the shape of an automobile, the shape, the dimensions and the construction of a glass plate for the automobile.

The embodiment as illustrated in the drawing is provided with the antenna conductor 6 at the upper part of the defogger 4 in the rear window glass plate 1 of the automobile. However, the antenna conductor 6 may be provided at the lower part, or both upper and lower parts of the defogger 4, or may be provided at another marginal portion.

The antenna conductor 6 is generally formed by using a printing method wherein electric conductive silver paste is printed in a form of wire in a predetermined pattern on a glass plate followed by baking the paste in the same manner as the heater strips of the defogger. However, the antenna conductor 6 may be formed by using a transparent electric conductive film or fine electric conductive wire arranged in a predetermined pattern.

In the embodiment of the present invention, a reactance circuit module 8 or 118 is inserted between the lead wires 5, 5' of the defogger 4 so that a current is caused to flow from the direct current power source 7 (or a d.c. power source 125) to the defogger 4 but a current of a high frequency band region such as radio wave frequency band region is interrupted. With the reactance circuit module 8 or 118, a current induced in the heater strips 2 and bus bars 3, 3' of the defogger based on radio waves of high frequency band regions such as radio wave broadcasting is prevented from flowing to the ground, and the induced current can be supplied to a radio wave receiver without any leakage. A numeral 9 or 119 designates a high frequency choke coil provided in the reactance circuit module 8 or 118. As the high frequency choke coil, there is used such one that exhibits a high impedance in high frequency band regions such as radio wave broadcast and does not cause residual magnetism. For instance, a high frequency choke coil having a bifilar winding on a magnetic core, a high frequency coil formed by winding a wire so as to cancel magnetic fluxes resulted by currents from a closed magnetic path, or a high frequency choke using a core having a high degree of magnetic saturation can be used. A capacitor 10 or 110 in the reactance circuit module 8 or 118 is to form an electric short circuit to a current causing noises having high frequency components in high frequency bands such a radio wave frequency bands. It is most desirable to use the choke coil having a self-resonance frequency of about 0.5 MHz–2.0 MHz, preferably 1.0 MHz–1.5 MHz.

In the present invention, a matching circuit 13 is inserted in a predetermined position between a power feeding terminal 11 of the antenna conductor 6 and a receiver 12 so that the impedance of the antenna conductor 6 in which a high frequency current is induced is made corresponding to or approximate to the impedance of the receiver 12 for receiving AM radio waves and the high frequency current is supplied to the receiver 12. The matching circuit 13 is constituted basically by a coil 14, a capacitor 15, a coil 16 and a resistor 17 so that the impedance of the matching circuit 13 becomes substantially constant in the entire area of desired broadcast frequency band regions, and the impedances of antenna conductor 6 viewed from the input terminal of the receiver, a functional part as an antenna in the rear window glass, namely, a part of the defogger 4 which is close to the antenna conductor 6 and functions as antenna by capacitive coupling, and an antenna feeding line extending to the input terminal exhibit as a whole a little capacitive reactance in desired broadcast frequency band regions. By providing the above-mentioned matching circuit 13, matching in impedance between the AM receiver 12 and the entire antenna system can be obtained and an effective antenna system can be realized.

The antenna conductor 6 and the defogger 4 are formed by printing electric conductive silver paste on the glass plate followed by baking it as described before. In this case, there may occur migration of silver printed on the glass plate between adjacent parts 6a, 4a of the antenna conductor 6 and the defogger 4 to thereby cause a short circuit. When the short circuit takes place, a large current flows into the receiver 12, 108. In order to prevent the large current from flowing, a capacitor 18 or 117 for blocking a d.c. current may be inserted between the power feeding terminal 11 or 107 of the antenna conductor 6 and the matching circuit 13 or a reactance two-terminal network circuit 109.

In the matching circuit for the antenna device to be installed in a glass plate for an automobile, especially the antenna device for receiving AM radio wave broadcast to be installed in the rear window glass of an automobile, it is preferable to use a capacitor 18 of a capacitance of 560 pF–1 μF, a coil 14 having an inductance of 82 μH–560 μH, a capacitor 15 having a capacitance of 10 pF–470 pF, a coil 16 having an inductance of 82 μH–560 μH and a resistor 17 having a resistance of 200ϕ–3 kϕ. The choke coil connected to the defogger preferably has an inductance of 0.2 μH–2 μH, and the capacitive coupling portion A between the antenna conductor part 6*a* and the defogger part 4*a* preferably has a capacitance of 50 pF–10,000 pF. Further, it is preferable that an antenna cable portion extending between the power feeding terminal 11 of the antenna conductor 6 and the input terminal of the AM receiver 12 is adapted to effectively transmit a high frequency current. For the above mentioned elements, typical examples are mentioned only, and modification can be made as to obtain desired performance depending on an antenna device for an automobile.

Figure 3A:
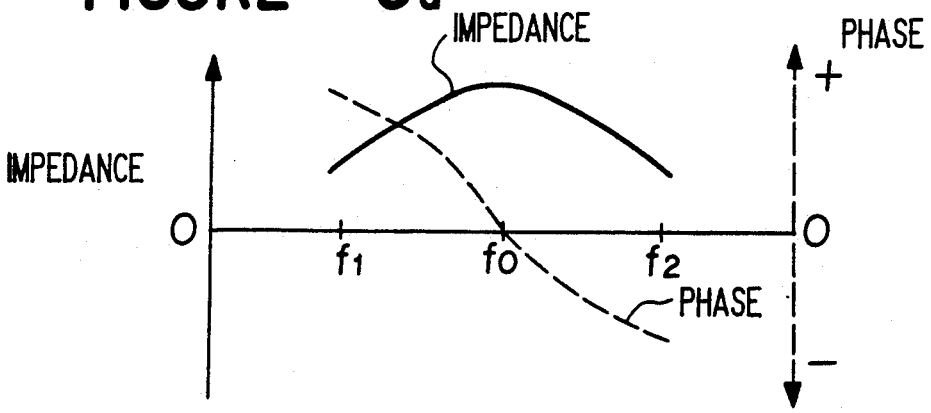
FIGS. 3*a*–3*d* are respectively electric characteristic diagrams of the antenna device for an automobile according to the present invention.

In the above-mentioned antenna device for an automobile of the present invention, when an anti-resonance phenomenon is produced by the choke coil 9 of the reactance circuit module 8 and the static capacitance at the area B between the defogger 4 and the rear window opening 19, and the central value $f_0$ between a frequency $f_1$ at the low frequency side in desired radio wave frequency band regions and a frequency $f_2$ at the high frequency side is rendered to be anti-resonance frequency, for instance, by determining the central value $f_0$=1,000 KHz (as the anti-resonance frequency) between $f_1$=500 KHz (AM broadcast frequency band) and $f_2$=1,500 KHz, the impedance of the defogger 4, namely, the defogger 4 formed by the heater strips and the bus bars of an electric conductive material, becomes the maximum at $f_0$ as shown in FIG. 3*a*. Namely, a leak current flowing from the defogger 4 to the rear window opening 19 of the automobiles becomes the minimum, whereby the reduction of sensitivity resulted by flowing a high frequency current induced by the radio waves for broadcasting in the defogger can be prevented.

Figure 3B:
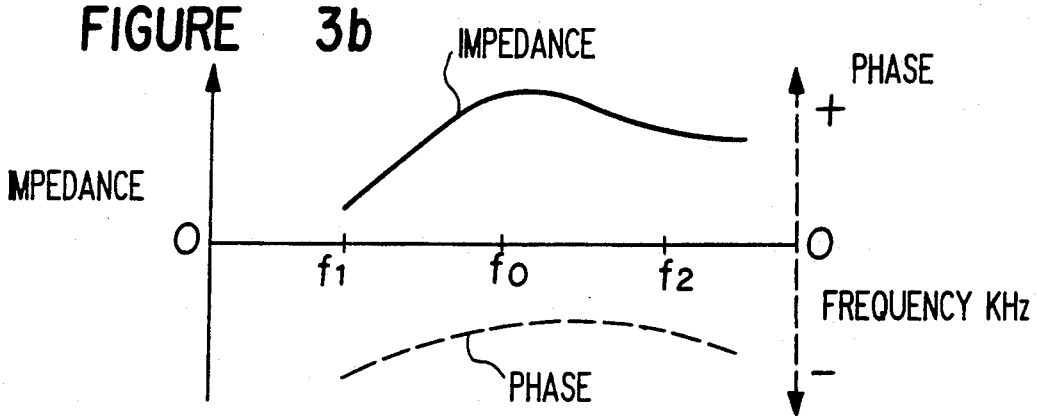

Since the defogger 4 and the antenna conductor 6 are rendered to be in a state of connection in terms of a high frequency waves in a desired broadcast radio wave frequency band region due to the capacitive coupling between the antenna conductor part 6*a* and the defogger part 4*a* which are close to each other, the defogger 4 functions as an antenna, and the impedance of the antenna conductor 6 viewed from the power feeding point 11 of the antenna conductor 6 and the impedance of the part of the defogger 4 which functions also as an antenna can be increased. Further, a quality factor value resulted by a stray capacitance produced in the choke coil 9 and resulted between the defogger and the rear window opening 19 can be a suitable value, whereby the ratio of the impedance of the antenna conductor viewed from the power feeding point 11 to the impedance of the input to the receiver approaches 1 as shown in FIG. 3*b*. Accordingly, efficiency in feeding power from the antenna device to the receiver can be improved, hence, a current in the antenna induced by radio waves can be supplied to the receiver without any leak.

Figure 3C:
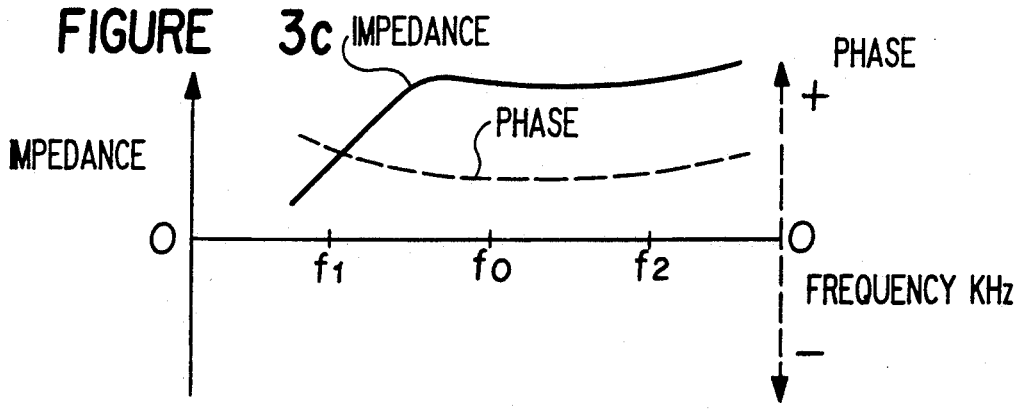

As described above, the matching circuit 13 having a reactance circuit comprising the coil 14, the capacitor 15, the coil 16 and the resistor 17 is inserted between the power feeding terminal 11 of the antenna conductor 6 and the receiver 12 as shown in FIGS. 1, 2, 4 and 5. In this case, the anti-resonance frequency obtained by the capacitor 15 and the coil 16 is determined to be the central value $f_0$ of a predetermined radio wave frequency band region and by inserting the resistor 17 in parallel to the capacitor 15 and the coil 16, whereby the quality factor can be in a suitable range, and the impedance curve of the reactance circuit can be gentle in the radio wave frequency band region as shown in FIG. 3*c*. Thus, a high sensitivity in receiving ratio waves can be obtained in frequency band regions.

Further, by connecting the coil 14 in series to a resonance circuit consisting of a parallel connection of the capacitor 15, the coil 16 and the resistor 17, a capacitive reactance in the region between the central value $f_0$ and the upper limit $f_2$ in the desired broadcast frequency band region is canceled and a flat inductive reactance can be produced. Thus, there is obtainable a function of low-pass filter by rendering the impedance of the antenna device viewed from the input terminal of the receiver 12 to be a capacitive reactance so that noises can be absorbed. Thus, a noiseless antenna can be obtained.

Figure 3D:
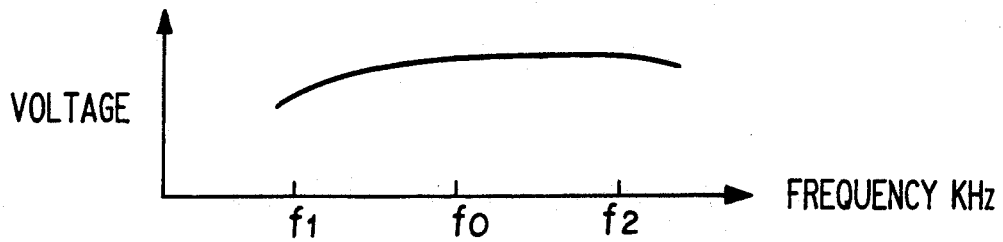

FIG. 3*d* is a diagram showing voltage characteristics of the antenna device in a desired broadcast frequency band at the input terminal of the receiver according to the present invention. As seen from the Figure, a gentle antenna characteristic curve is obtainable at both sides of the central frequency $f_0$.

Figure 4:
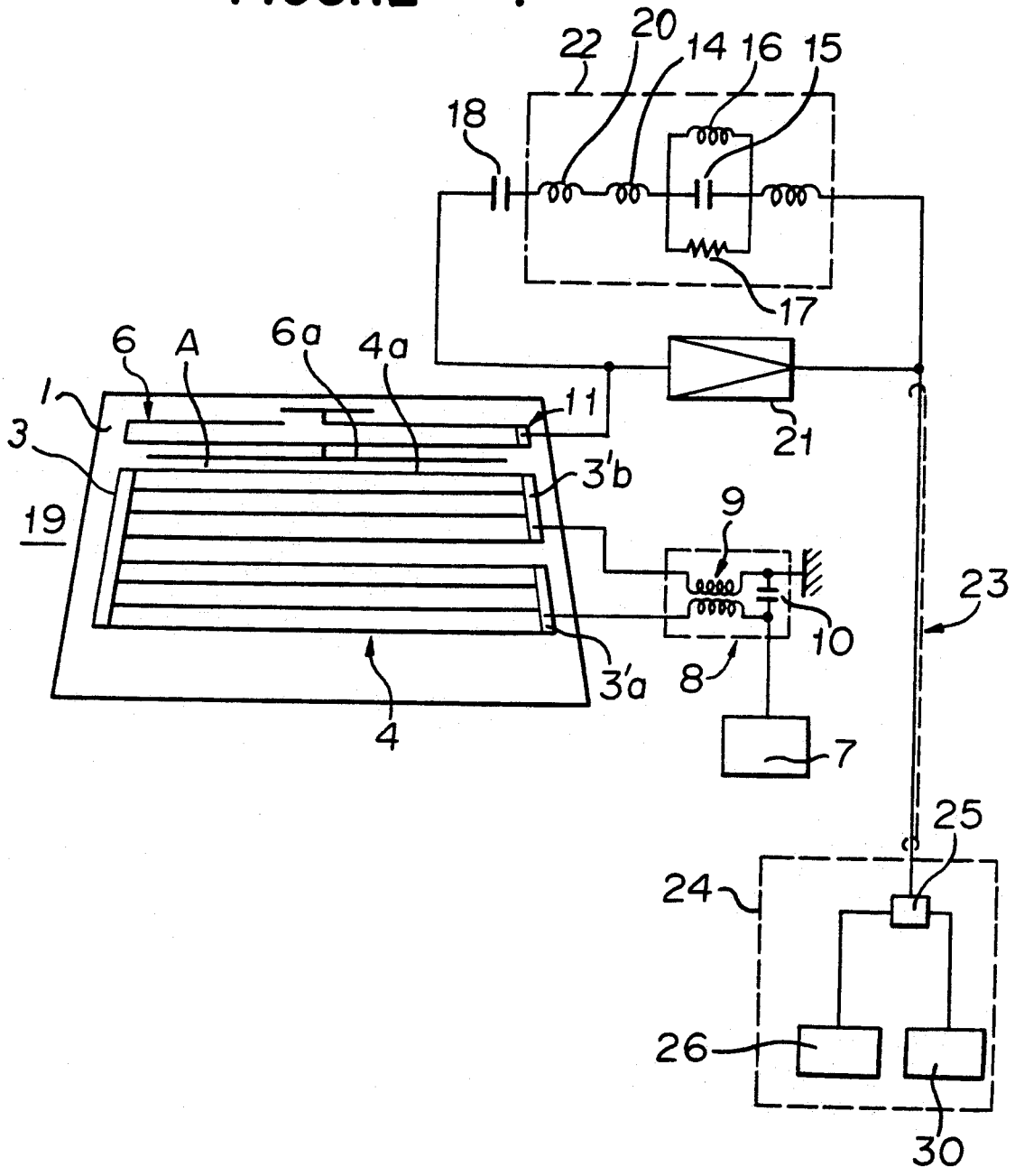

FIG. 4 is a diagram showing another embodiment of the antenna device for an automobile of the present invention, which is a modification of the embodiment as shown in FIG. 2. In FIG. 4, a coil 20 does not cause the resonance of a signal passing through a pre-amplifier 21 in an FM carrier frequency band so that it interrupts the signal. The coil 20 has a self-resonance frequency at the center of the FM carrier frequency band. The signal for the pre-amplifier 21 for FM broadcast and the matching circuit 22 is transmitted to a receiver module 24 through coaxial cable 23. The smaller the capacitance of the coaxial cable 23 is, the better result is obtainable. Especially, it is preferable that the capacitance is in a range of 50 pF/m–200 pF/m. A dividing circuit 25 receives AM/FM mixing signals, and the dividing circuit separates an AM signal and an FM signal to be supplied respectively to an AM receiver 30 and an FM receiver 26.

Figure 5:
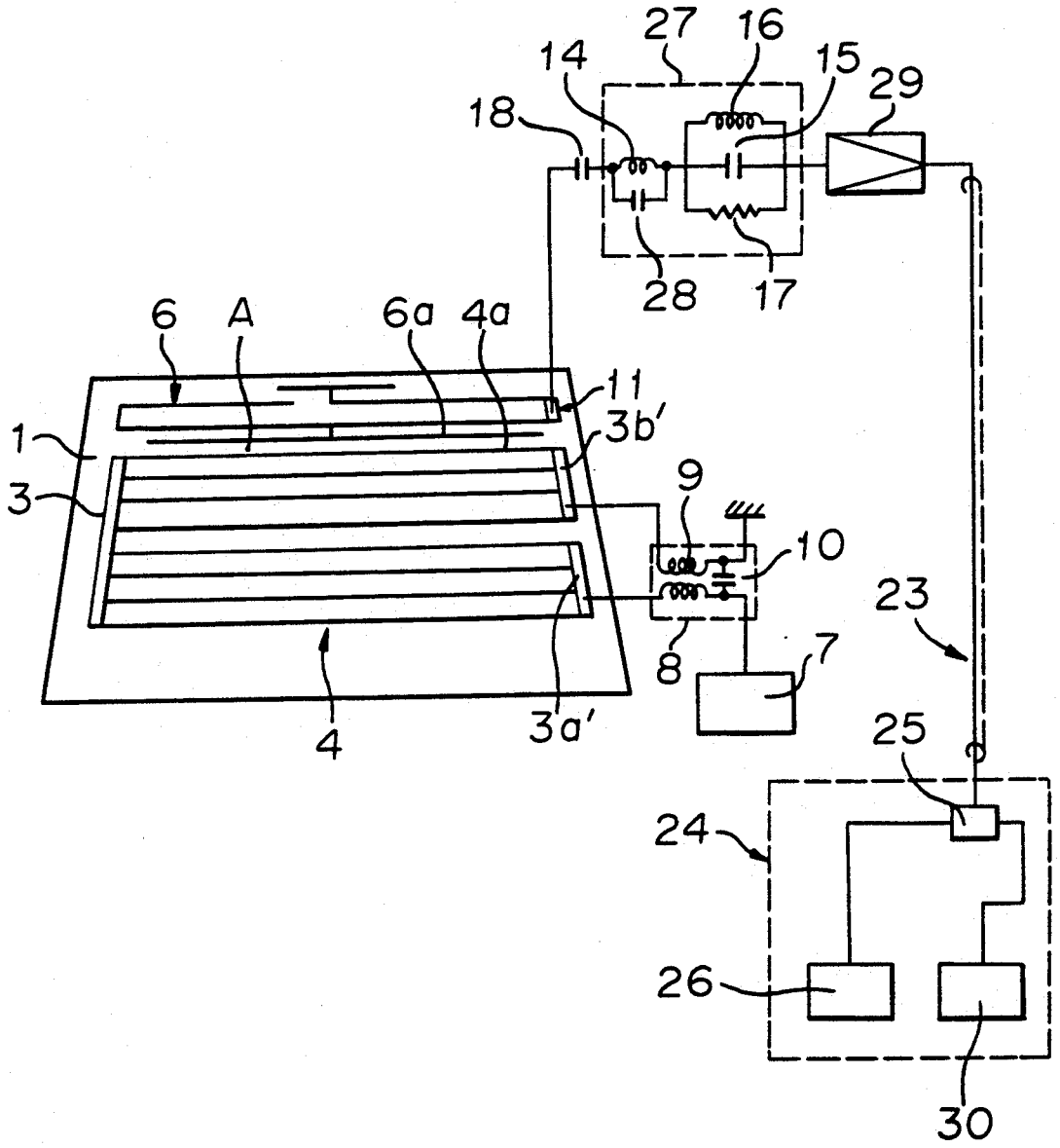

FIG. 5 is a diagram showing another embodiment of the antenna device of the present invention which is a modification of the embodiment shown in FIG. 2. In this embodiment, the antenna 6 is used commonly for receiving AM and FM broadcast radio waves. Accordingly, the reactance circuit 27 permits a received signal to pass therethrough by means of capacitors 28, 15, 18 in FM frequency band regions but it functions as a matching circuit in AM frequency band regions. A signal is passed through the pre-amplifier 29 in the AM frequency band regions but it is amplified in the FM band regions. Accordingly, it is possible for signals of AM and FM waves to pass the reactance circuit 27 and the pre-amplifier 29.

The matching circuit 13, 22 or 27 may be placed or attached on or near the power feeding point of the glass plate 1.

In the embodiment as shown in FIG. 8, a reactance two-terminal network circuit 109 is connected at a desired position between a power feeding point 107 for the antenna conductor 6 and a radio wave receiver 108 mounted on an automobile.

Figure 9:
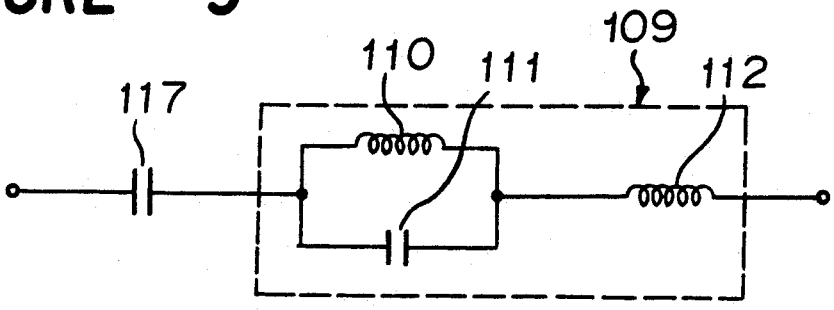
FIGS. 9–11 are respectively diagrams showing embodiments of a reactance two-terminal network circuit to be applied to the embodiments of the present invention.

The reactance two terminal network circuit 109 is basically a reactance circuit constituted by a first coil 110, a first capacitor 111 and a second coil 112 as shown in FIG. 9. The operation of matching is effected between the radio wave receiver 108 and the reactance two-terminal network circuit 109. The impedance of the reactance circuit viewed from the power feeding point 107 is generally of a nature of inductive in the entire region of FM radio carrier wave frequency, for instance in a band region of 70 MHz–100 MHz wherein the value of each of the elements is selected so that the impedance have a constant value.

It is preferable that the impedance of the reactance two-terminal network circuit is such that the absolute value is in a range of 70Ω–130Ω and the phase angle is in a range of +60°–+80° in the entire region of FM radio carrier wave frequency.

When it is expected to receive AM radio wave at a noiseless level and with sufficient performance, it is preferable to render the impedance of the antenna conductor viewed from the input terminal of the radio wave receiver in the reactance two terminal network circuit to be a nature of inductive in the entire region of AM radio carrier wave frequency.

Figure 16A:
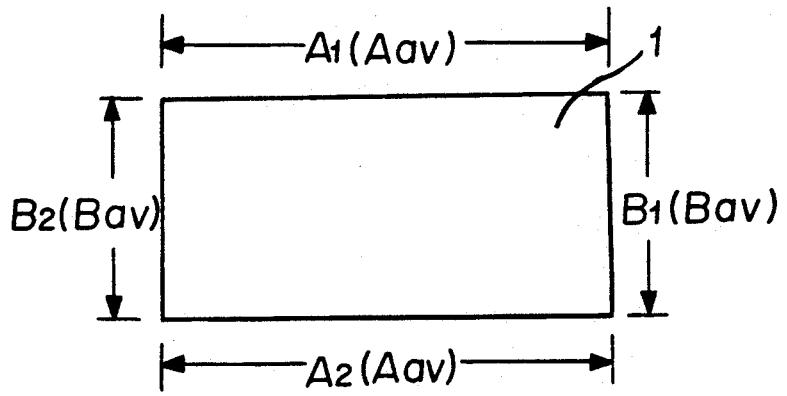
FIGS. 16*a*–16*c* are respectively plane views of glass plate applied to the antenna device of the present invention.
Figure 16B:
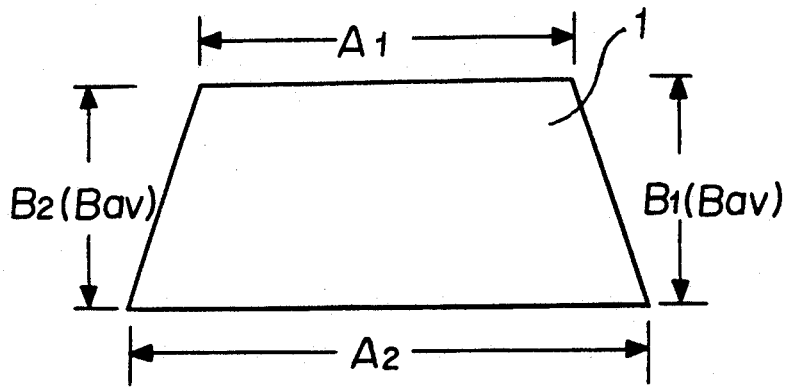
Figure 16C:
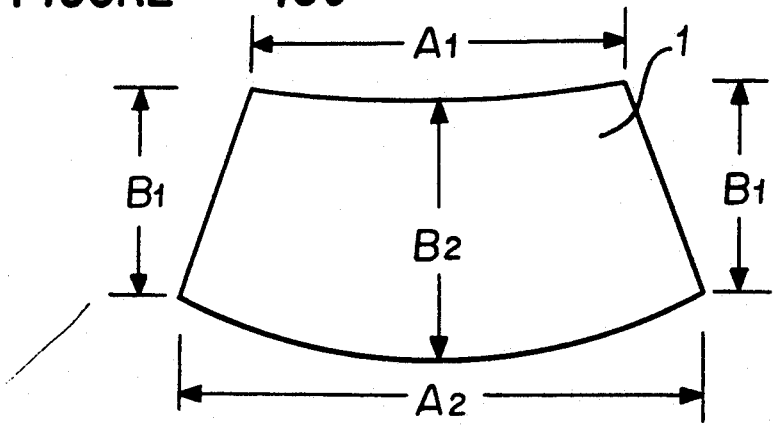

Generally, a rectangular, a trapezoidal or a sectorial glass plate is used for the rear window glass for automobiles. In this case, as shown in FIGS. 16*a*, 16*b* and 16*c*, it has been experimentally confirmed that sensitivity and non directivity, especially the non-directivity to FM carrier waves can be improved by determining the average length Aav of the length in the lateral direction A1, A2 to be at least 1.7 times as the average height Bav of the height B1, B2 in the longitudinal direction, preferably to be about 1.7 times –4 times.

Figure 10:
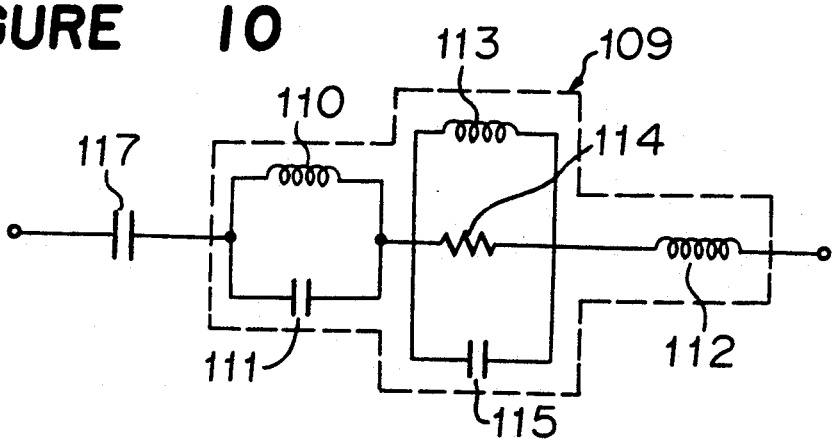

FIG. 10 is a diagram of an embodiment of the reactance two-terminal network circuit used for the antenna device for the automobile, particularly for the antenna device installed in the rear window glass of an automobile so as to receive FM broadcast or FM/AM broadcast. In the network circuit as shown in FIG. 10, it is preferable that the capacitance of a coil 110 is in a range of 160 μH–500 μH, the sum of the stray capacitance of the coil 110 and the capacitance of the capacitor 111 is in a range of 5 pF–15 pF, the inductance of a coil 113 is in a range of 120 μH–260 μH, the sum of the stray capacitance of the coil 113 and the capacitance of a capacitor 115 is in a range of 64 pF–100 pF and the resistance of a resistor 114 is in a range of 800Ω–1,200Ω, more preferably 900Ω–1,100 Ω, the inductance of a coil 112 is in a range of 0.3 μH –1.2 μH, preferably 0.5 μH–1.0 μH, wherein the stray capacitance of the coil 112 is 0.5 pF or less and the capacitance of a capacitor 117 is in a range of 1,000 pF–10,000 pF. The above-mentioned values are raised as typical examples of value, and it is possible to modify them to obtain suitable performance depending on antenna devices for automobiles.

The function of the antenna device of the present invention in FM carrier wave frequency band regions will be described.

Figure 11:
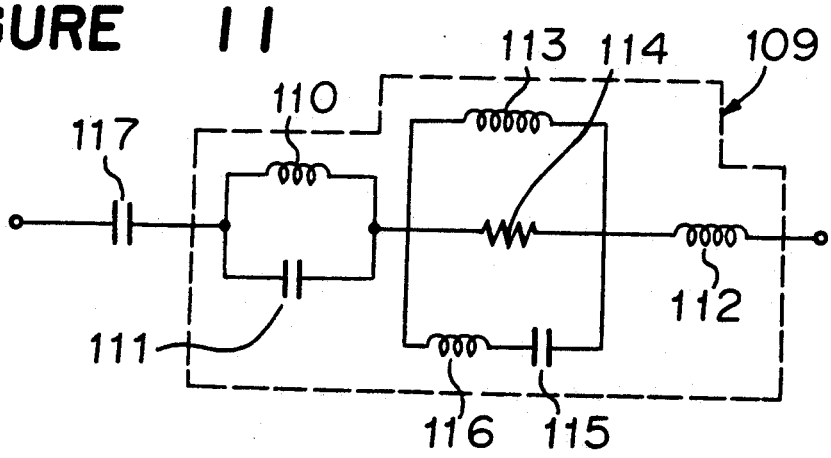
Figure 12:
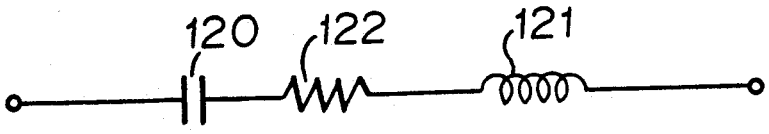
FIG. 12 is a diagram of equivalent circuit in an FM radio carrier wave frequency band region of the circuit as shown in FIG. 9.

Since a choke coil 119 having a self-resonance frequency in a range of 1.0 MHz–1.5 MHz exhibits an extremely small impedance in an FM radio carrier wave frequency and regions, the potential of the defogger 4 is the same as the body of the automobile on which the antenna device of the present invention is mounted. When the reactance two-terminal network circuit 109 is constructed as shown in FIGS. 9–11, it has an equivalent circuit as shown in FIG. 12 where the capacitive impedance of a capacitor 120 is added to the inductive impedance of a coil 121, whereby it is obtainable an impedance having a phase of +65°–+85° and a resistance of 70Ω–130Ω by adding the pure resistance component of the resistor 122.

Because the characteristic impedance of a coaxial cable 123 connecting the reactance two terminal network circuit 109 to the radio wave receiver 108 is usually of a nature of capacitive and has a resistance of about 50Ω. On the other hand, the input impedance of the radio wave receiver has usually about 100Ω. Accordingly, good electric matching effect is obtainable between the reactance two terminal network circuit 109 and the radio wave receiver 108, especially an FM radio wave receiver, and a sufficient sensitivity for receiving radio waves can be obtained.

Since the antenna conductor 6 is of a nature of capacitive reactance between a car body 124 and the defogger 4, it is canceled by the inductive reactance of the reactance two-terminal network circuit 109, whereby FM radio wave can be effectively received.

Normally, FM radio waves pass a receiving current to the body and the defogger 4 of an automobile with respect to the ground, and the receiving current is induced in the antenna conductor 6. Accordingly, the directivity of an electric field varies depending on the shape of the automobile, the shape of the glass plate, the wiring pattern and the shape of the heater strips of the defogger and the arranged pattern and the shape of the antenna conductor. The directivity can be further improved by rendering the impedance of the antenna viewed from the power feeding point 107 to be 70Ω–130Ω, especially 90Ω–110Ω and by rendering the length in the horizontal direction of the glass plate to be 1.7 times or more as the length in the longitudinal direction of the glass plate.

In the antenna device for an automobile of the present invention, although AM radio waves can be received with good sensitivity and a low noise level, the function of AM radio carrier frequency band region is considered as follows.

Since the impedance between the defogger 4 and the ground is increased by the presence of the choke coil 119 inserted in a power feeding line of the defogger 4 having a high self-resonance frequency, the defogger 4 is considered to be separated from the ground. Noises caused by a power source 125 is absorbed by a capacitor 126 in addition to the choke coil 119. When the defogger 4 is so arranged that it is close to and in parallel to a part of the conductor of the antenna conductor 6, the defogger 4 can be considered as a part of an antenna by a capacitive connection. When the reactance two-terminal network circuit 109 as shown in FIG. 10 is used, an equivalent circuit as shown in FIG. 13 is obtainable in an AM radio carrier wave frequency band region.

Figure 13:
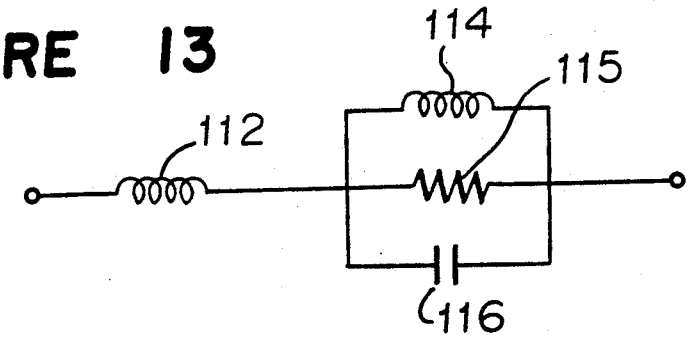
FIG. 13 is a diagram of equivalent circuit in an AM radio carrier wave frequency band region of the reactance two-terminal network circuit as shown in FIG. 10.
Figure 14:
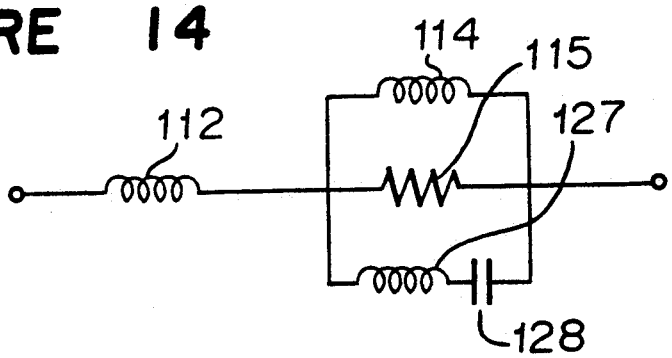
FIG. 14 is a diagram of equivalent circuit in an AM radio carrier wave frequency band region of the reactance two-terminal network circuit as shown in FIG. 11.

The reactance two-terminal network circuit as in FIG. 13 can be electrically matched with the antenna impedance viewed from the power feeding point 107 in the entire region of the AM radio carrier wave frequency of the radio wave receiver 108.

Figure 17:
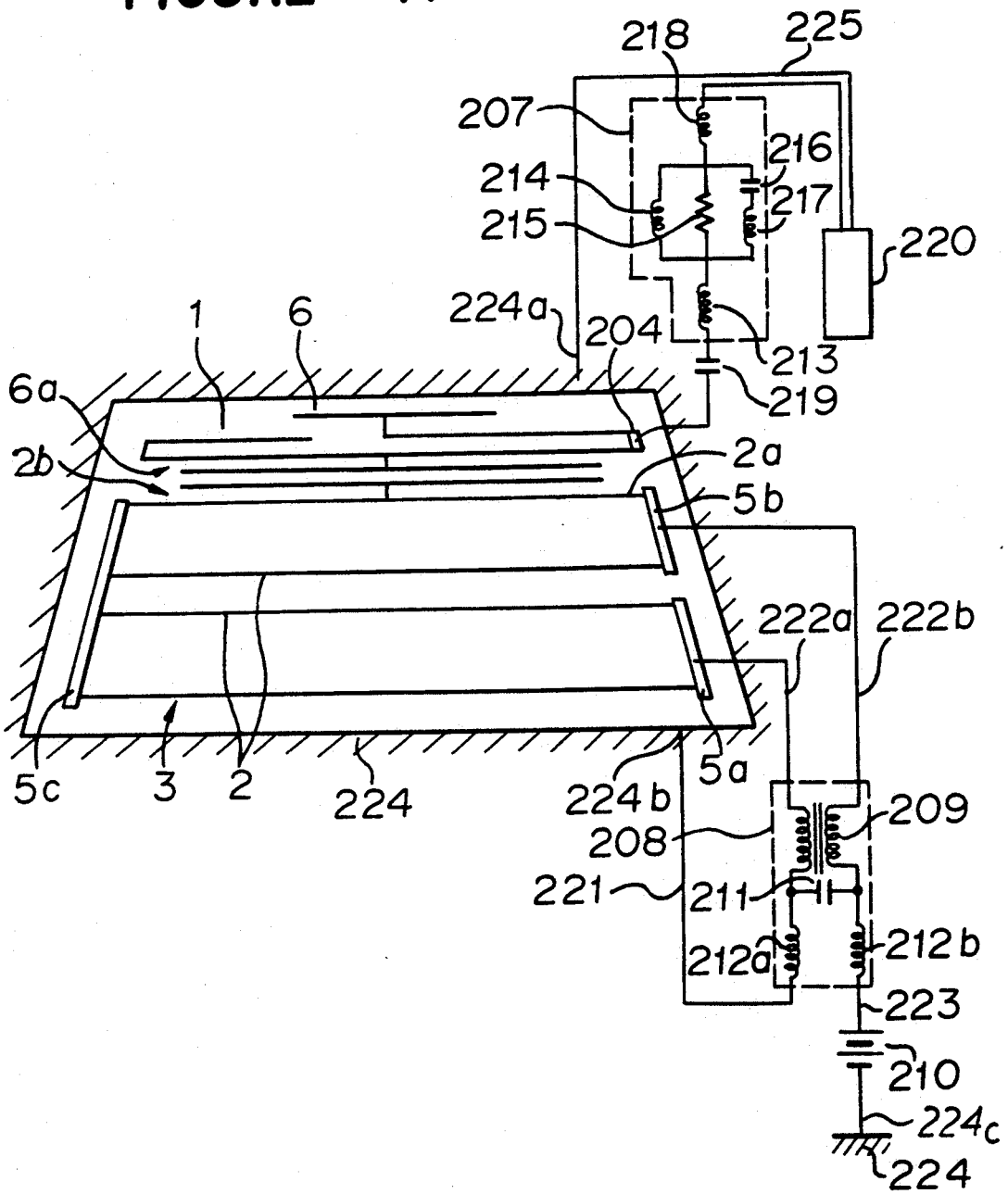
FIG. 17 is a diagram showing another embodiment of the antenna device for an automobile according to the present invention.

In the antenna device for an automobile as shown in FIG. 17, a matching circuit 207 is inserted at a desired position between the power feeding point 204 of the antenna conductor 6 and a radio wave receiver 220. A high frequency current induced in the antenna conductor 6 is effected for resonance by the impedances of the matching circuit 207, the receiver 220 and the antenna conductor viewed from the matching circuit 207, and supplied to the receiver 220. The matching circuit 207 comprises a circuit constituted by coils 213, 214, 217 and 218, a capacitor 216 and a resistor 215. In an AM broadcast frequency band region, the electric characteristics can be determined by the coils 213, 214, 217, the capacitor 216 and the resistor 215. In an FM broadcast frequency band region, since the self-resonance frequency of the coils 213, 214, 217 is low, they show a capacitive reactance. The electric characteristics can be determined by using a core made of Ni - Zn ferrite or by inserting a solenoid or spirally wound coil 218.

High frequency coils 212*a*, 212*b* in the reactance circuit 208 exhibit a high impedance in FM broadcast frequency band regions. Accordingly, a solenoid without having a magnetic core, a spirally wound coil or a lead wire having a suitable length is used for the coils 212*a*, 212*b*. Since the high frequency choke coil in a heater transformer 207 is low in self resonance frequency in the broadcast frequency band regions, the inductance is lost. Accordingly, the high frequency coils 212*a*, 212*b* are used for the high frequency choke coil.

In order to have the matching circuit 207 achieved good performance, it is necessary that the reactance circuit 208 is inserted between the bus bar of the defogger and a d.c. power source 210 so that anti-resonance is effected, at the band region on a side of the center frequency of each FM or AM broadcast frequency band region, by the impedance of the reactance circuit 208 and the impedance of electric static capacitance viewed from the connecting part of lead wires of the bus bar, in the antenna conductor 6, the defogger 3 and the body of the automobile, wherein a quality factor value Q for the AM broadcast frequency band region is determined to be $Q \leqq 1.2$ and a quality factor value Q for the FM broadcast frequency band region is to be $Q \leqq 2.4$ so that the resonance characteristic of the quality factor for effecting the anti-resonance becomes relatively flat; and the matching circuit 207 is inserted between the power feeding point of the antenna conductor 6 and a receiver 220 so that resonance is effected, at the band region of the other side of the center frequency of each of the FM or AM broadcast frequency band region, by the impedance of the matching circuit 207 and the input impedance of the receiver 220 and the impedance of the antenna conductor 6 viewed from the matching circuit 207, wherein a quality factor value Q for the AM broadcast band region is determined to be $Q \leqq 1.2$ and a quality factor value Q for the FM broadcast frequency band region is to be $Q \leqq 2.4$ so that the resonance characteristic of the quality factor for effecting the resonance becomes relatively flat.

The frequency for causing the anti-resonance and the resonance is preferably determined in ranges of 550 KHz-40 KHz and 1050 KHz-1320 KHz in the AM broadcast frequency band regions, especially 580 KHz-610 KHz and 170 KHz-1230 KHz in the Japanese broadcasting system. For the FM broadcast frequency band regions, it is desirable to use the ranges of 77.5 MHz-80.5 MHz and 84 MHz-88 MHz, more preferably, 78.5 MHz-79.5 MHz and 85 MHz-87 MHz, of course, foreign countries have their own frequency band regions for broadcasting.

In order to satisfy the above-mentioned conditions, usually the circuit constant of the matching circuit 207 and the circuit constant of the reactance circuit 208 are suitably adjusted because the pattern of the antenna conductor 6 is fixed in a glass plate.

It is difficult to manufacture the reactance circuit 208 having a high self-resonance frequency because a large current is passed therethrough. Therefore, it is desirable that the anti-resonance is effected at a low frequency region with respect to the center frequency in terms of logarithmic scale of each of the FM and AM broadcast frequency band regions and the resonance is effected at a higher region than the center frequency.

In the matching circuit used for the antenna device of the present invention, the capacitor 219 of 560 pF-1 μF, the coil 213 of 82 μH-560 μH, the capacitor 216 of 5 pF-220 pF, the coils 214, 217 of 82 μH-700 μH and the resistor 215 of 200Ω-3 KΩ are preferably used in the AM broadcast frequency band regions. For the FM broadcast frequency band regions, it is preferable to use the coil 218 of 1 μH-10 μH in addition to the above-mentioned elements. On the other hand, for the high frequency choke coil in the reactance circuit 208 connected to the defogger 4 is preferably determined to be 1.0 mH-3 mH in the AM broadcast frequency band regions. On the other hand, for the coils 212*a*, 212*b*, they are preferably so determined as to be 1 μH-5 μH in the FM broadcast frequency band regions. The capacitance of the capacitive coupling portion between the antenna conductor part 6*a* and a branch line 2*b* of the heating strip 2*a* is preferably determined to be 50 pF-10,000 pF in both FM and AM broadcast frequency band regions. Further, a cable portion 225 extended between the power feeding point 204 of the antenna conductor 6 and the input terminal of the receiver 220 through the matching circuit 207 is adapted to transmit a high frequency current effectively. As a preferred example, a coaxial cable, a feeding line or the like is preferably used.

The above-mentioned values for the coils, capacitors and resistors are raised as typical examples, and it is possible to change the values so as to obtain the optimum performance depending on an antenna device for an automobile.

The length of an earth line 224*a* to be connected to the automobile body as a negative pole of the cable 225 and an earth line 224*c* connected to the automobile body as a negative pole of the d.c. power source 210 are preferably 30 cm or more, preferably 60 cm or more so as to reduce noises.

In the antenna device for an automobile in accordance with the present invention, sensitivity for receiving radio waves can be maintained in the entire region of the radio wave broadcast frequency band regions by reducing a leak current from the defogger 4 by causing the anti-resonance in the band region at a side of the center frequency of a broadcast frequency band region in terms of logarithmic scale and by causing resonance by utilizing the matching circuit in the region other than the side of the center frequency. This is because sole use of the reactance circuit 208 or the matching circuit 207 can not cover the entire region of the FM and AM broadcast frequency band regions.

For this purpose, the anti-resonance is effected at a low frequency region with respect to the center frequency of a selected broadcast frequency band region for the reactance circuit 208 and the resonance is effected at a higher region for the matching circuit 207. With respect to the reactance circuit 208, it is necessary to pass a large amount of current and a high, degree of technique is required to manufacture the reactance circuit having a high self-resonance frequency.

In the following, an example will be described as to the reactance circuit in which the anti-resonance is effected at a low frequency region in order to simplify explanation.

The present invention derives from the technical concept described below. Anti-resonance is effected at a low frequency region by the impedance of a portion functioning as an antenna and the impedance of the reactance circuit 208 to thereby prevent a receiving current of broadcasting radio waves induced in the defogger 4 from flowing to the ground, and resonance is effected around the center frequency in terms of logarithmic scale in a high frequency region, which is caused by the impedance of the part functioning as the antenna and the matching circuit to thereby increase the sensitivity. In the reactance circuit 208, when one having a high self resonance frequency is used, it is possible to obtain the anti-resonance at a high frequency region and to obtain the resonance at a low frequency region.

In the antenna device according to the present invention, an anti-resonance phenomenon is produced at a low frequency region with respect to the center frequency in terms of logarithmic scale of each of the FM and AM broadcast frequency band regions between the impedance mainly composed of static capacitance formed by the cooperation of the three elements of the antenna conductor 6, the defogger 4 and the rear window opening and the impedance of the reactance circuit 208.

When the center value in terms of logarithmic scale between the frequency $f_L$ of the lowest region and the frequency $f_H$ of the highest region in each of the FM and AM broadcast frequency band regions is expressed by $f_M$ determination is so made that the center value $f_{LM}$ in terms of logarithmic scale between $f_L$ and $f_M$ is a frequency which causes the anti-resonance. For instance, the impedance of the defogger 4 and the rear window opening 24 becomes the largest at a frequency value $f_{LM}$ by determining the circuit constant of the reactance circuit 208 so that the center frequency $f_{LM}$ in the lower frequency region is about 600 KHz ($f_{LM} \approx 600$ KHz) as the anti-resonance frequency in the AM broadcast frequency band region when $f_M \approx 900$ KHz between $f_L \approx 500$ KHz and $f_H = 1600$ KHz. Namely, a leak current from the defogger 4 to the rear window opening 24 becomes the smallest, and the leakage of a high frequency current induced in the defogger 4 to the automobile body can be prevented, hence reduction in the sensitivity can be prevented.

Similarly, when $f_M \approx 82$ MHz, $f_L = 76$ MHz, $f_H = 90$ MHz and $f_{LM} \approx 79$ MHz in the FM broadcast frequency band regions, the same phenomenon takes place.

In the reactance circuit 208, since the inductance of the coils 212*a*, 212*b* in the AM broadcast frequency band regions is sufficiently smaller than the inductance of the heater transformer 209, the inductance of the coils is negligible. Further, since the self-resonance frequency of the coil 209 is low in the FM broadcast frequency band regions, hence the coil 209 becomes of a capacitive reactance, the coils 212*a*, 212*b* function as inductive elements.

In the case as described above, when the quality factor value Q is made small as possible in the both FM and AM broadcast frequency band regions, the above-mentioned impedance can be averaged in the respective FM and AM broadcast frequency band regions, whereby a leak current can be small in average.

The defogger 4 and the antenna conductor 6 becomes such a state that they are connected in a high frequency range in both the FM and AM broadcast frequency band regions by the capacitive coupling between the adjacent portion 6*a* of the antenna conductor 6 and the branch line 2*b* of the heating strip 2*a* of the defogger 4. Further, they are isolated from the automobile body, whereby the defogger 4 functions as an antenna in the same manner as the antenna conductor 6.

The quality factor value Q, which determines the circuit constant of the matching circuit 207 so as to cause the resonance at the center frequency value $f_{HM} \approx 1200$ KHz in terms of logarithmic scale of $f_M \approx 900$ KHz and $f_H = 1600$ KHz in the AM broadcast frequency band regions and also determines the circuit constant of the matching circuit 207 so as to cause the resonance at $f_M \approx 82$ MHz, $f_H \approx 90$ MHz and $f_{HM} \approx 86$ MHz in the FM broadcast frequency band regions, should be small as possible so that the quality factor value Q is flat in areas $f_M$ and $f_H$ in the AM and FM broadcast frequency band regions. Theoretically, the quality factor value is determined to be nearly 0. Thus, power can be effectively transmitted from the antenna to the receiver 220 so that an induced current in the antenna due to radio waves coming thereto can be supplied to the receiver 220.

Explanation will be made in detail as to the resonance in the AM and FM broadcast frequency band regions. The matching circuit 207 having reactance components constituted by the coils 213, 214, 217, 218, the capacitor 216 and the resistor 215 as shown in FIG. 17 is inserted between the power feeding point 204 of the antenna conductor 6 and the receiver 220. In the case of the AM broadcast band regions, the resonance frequency obtained by the coils 213, 214, 217, the capacitor 216, all parts functioning as an antenna, and the receiver 220 is set to be the above-mentioned value $f_{HM}$, and a quality factor value Q is rendered to be the optimum value by the coils 214, 217 and the resistor 215, whereby substantially averaged high sensitivity can be obtained in the AM broadcast frequency band regions. Further, in the case of the FM broadcast frequency band regions, the coils 213, 214, 217, the resistor 215 and the capacitor 216 provide a capacitive reactance due to the stray capacitance in each of the elements, which causes resonance at the above mentioned frequency $f_{HM}$ in association of the coil 218, antenna elements and the input impedance of the receiver (in the matching circuit 207, only the coil 218 is effective in the FM broadcast frequency band regions), and a signal received by the antenna is transmitted to the receiver in the optimum form. Thus, high radio wave receiving sensitivity can be obtained in various frequency band regions.

The matching circuit 207 causes the resonance at the above-mentioned value $f_{HM}$ with the all elements functioning as the antenna and the input impedance Of the receiver 220. The capacitor 219 provides a nature of capacitive reactance to function as a low-pass filter so that a noiseless antenna for absorbing noises is obtainable.

EXAMPLE 1

Figure 6:
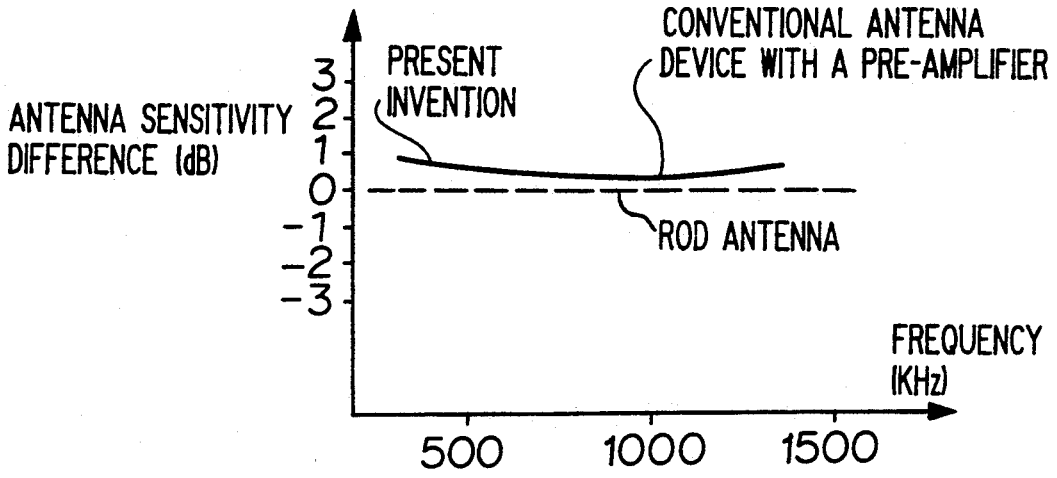
FIGS. 6 and 7 are respectively characteristic diagrams of the embodiments of the antenna device according to the present invention.
Figure 7:
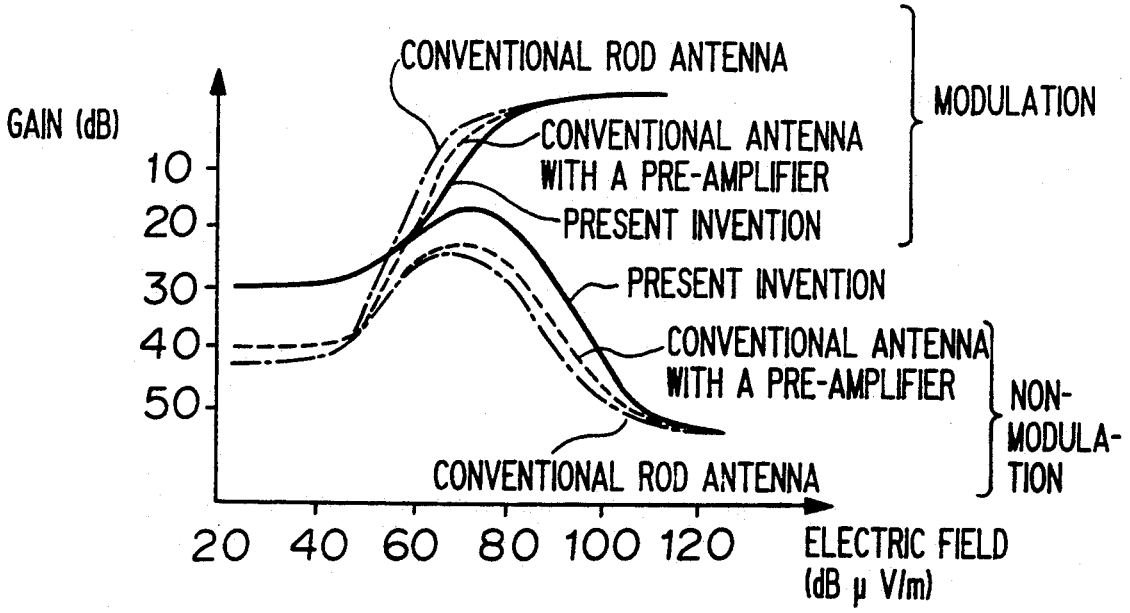

An antenna device for an automobile as shown in FIG. 2 was prepared. In the antenna device, a capacitor 18 of 1,000 pF, a coil 14 of 220 μH, a capacitor 15 of 270 pF, a coil 16 of 270 μH, a resistor 17 of 1 KΩ, a capacitive coupling portion between a portion 6a of the antenna conductor and a portion 4a of the defogger of 100 pF, a choke coil 9 of 200 μH, a capacitor 10 of 2 μF and an antenna cable portion between the power feeding terminal 11 of the antenna conductor 6 and the input terminal 12 of the receiver of 30 pF/m were used. The characteristics of antenna gain and S/N ratio of the antenna device to AM broadcast frequency band regions are as shown in FIGS. 6 and 7. An antenna device for AM broadcast of a high gain and a low noise level was obtained.

EXAMPLE 2

As shown in FIG. 8, a defogger 4 is provided at the center part of a glass plate 1 for the rear window glass of an automobile. An electric current is supplied from a d.c. power source 125 having a potential of 12V through a bus bar 13 to the defogger 4. A capacitor 126 is to prevent noises from the power source 125 from being transmitted to the antenna conductor. The self-resonance frequency of a choke coil 119 of a reactance circuit module 118 is 1.0 MHz.

An antenna conductor 6 is provided at the upper portion of the glass plate to be connected to a reactance two-terminal network circuit through a power feeding point 107. The network circuit is connected to a radio wave receiver 108 which is capable of receiving FM radio waves or FM/AM radio waves. Carrier wave frequencies for receiving radio waves are respectively 400 KHz–1.7 MHz and 70 MHz–100 MHz. As the reactance two-terminal network circuit, the circuit as shown in FIG. 10 is used wherein the capacitance of a capacitor 117 is 10,000 pF, the inductance of a coil 110 is 330 μH, the sum of the stray capacitance of the coil 110 and the capacitance of a capacitor 11 is 10 pF, the inductance of a coil 113 is 180 μH, the sum of the stray capacitance of the coil 113 and the capacitance of a capacitor 115 is 82 pF, the resistance of a resistor 114 is 1 KΩ, and a coil which is formed by turning a copper wire of 0.47 mm by 7 turns to have a diameter of 7 mm in order to minimize the stray capacitance wherein the inductance is 1.0 μH and the stray capacitance is 0.2 pF, are respectively used.

FIG. 11 is a modification of FIG. 10. The embodiment of the reactance two terminal network circuit as shown in FIG. 11 is capable of not only receiving FM radio waves with good sensitivity and at a low noise level but also providing a constant impedance regardless of frequencies in AM radio waves. In FIG. 11, a coil 113 of 150 μH, a coil 116 of 150 μH, a capacitor 115 of 33 pF and a resistor 114 of 680Ω are used. FIG. 13 shows an equivalent circuit of the AM radio frequency.

Figure 15:
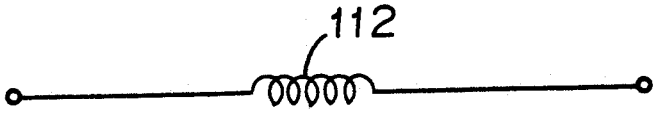
FIG. 15 is a diagram of equivalent circuit in a radio carrier wave frequency band region of the reactance two-terminal network circuit as shown in FIG. 9.

FIG. 9 shows a simplified form of the embodiment as in FIG. 10. In FIG. 9, a coil 110 of 270 μH is used. FIG. 15 shows an equivalent circuit of the AM radio frequency.

EXAMPLE 3

An antenna device for an automobile as shown in FIG. 17 was prepared. The values of each element in an AM broadcast frequency band region are as follows: a capacitor 219 is 0.01 μF, a coil 213 is 300 μH, a coil 214 is 150 μH, a resistor 215 is 680Ω, a capacitor 216 is 27 pF, a coil 217 is 330 μH, a capacitive coupling portion of a part 6a of the antenna conductor and a part 2b of the defogger is 90 pF, the inductance of a heater transformer 209 is 400 μH, a capacitor 211 is 2.2 μF, and an antenna-cable portion extending between the feeding point 204 of the antenna conductor 6 and the input terminal of a receiver 220 is 30 pF/m. The characteristics of antenna gain and S/N ratio of the antenna device to the AM broadcast frequency band region as shown in FIGS. 18 and 19 were obtained.

Figure 18:
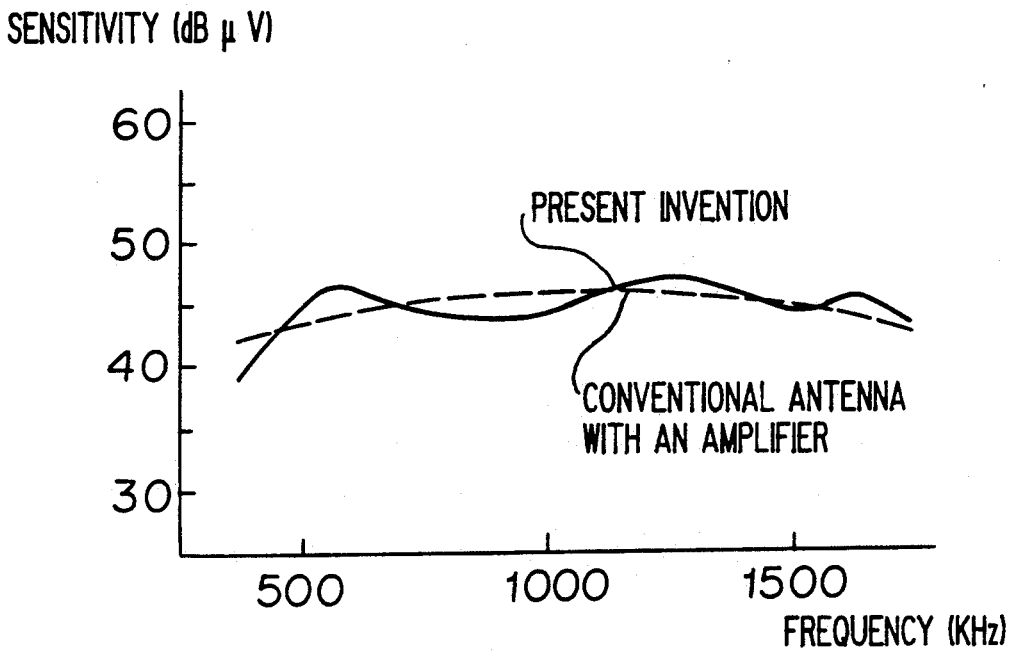
FIG. 18 is a frequency characteristic diagram in an AM broadcast frequency band region of the antenna device of the first example.

FIG. 18 is a diagram showing antenna gains to the frequencies in the AM broadcast frequency band region obtained when the intensity of an electric field near the antenna device is 60 dBμV/m. As in FIG. 18, the antenna gain is substantially the same as those of the conventional antenna device having a pre amplifier.

Figure 19:
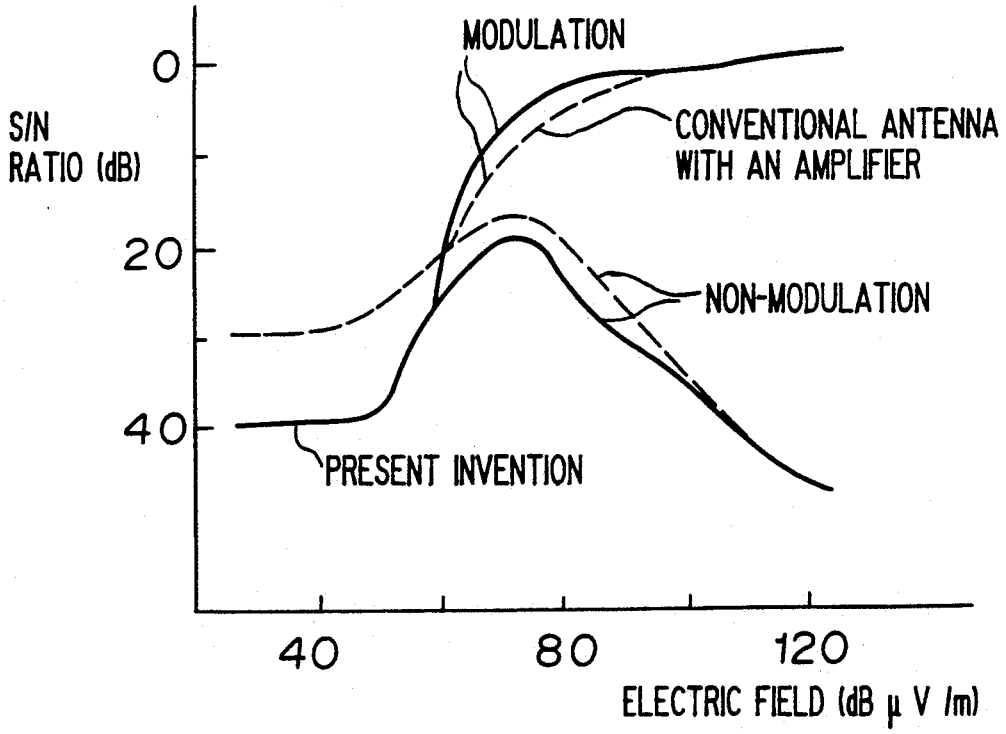
FIG. 19 is a diagram showing the S/N ratio in an AM broadcast frequency band region of the antenna device of the first example.

FIG. 19 is a diagram showing a relation of S/N ratio at the time of non-modulation and at the time of modulation to electric field intensity when the frequency of carrier waves is 400 Hz. In FIG. 19, the non-modulation means that the degree of modulation=0, and the modulation means that the degree of modulation=30%. The S/N ratio is not distinguishable from that of the conventional antenna device with an amplifier in a strong electric field. However, in a weak electric field, the antenna device of the present invention provides better results.

Thus, the same high gain is obtainable by the antenna device of the present invention in the AM broadcast frequency band regions in the same manner as the conventional antenna device having an amplifier to increase antenna gain. Further, the antenna device of the present invention suppresses noises in the ordinary weak electric field.

Figure 20:
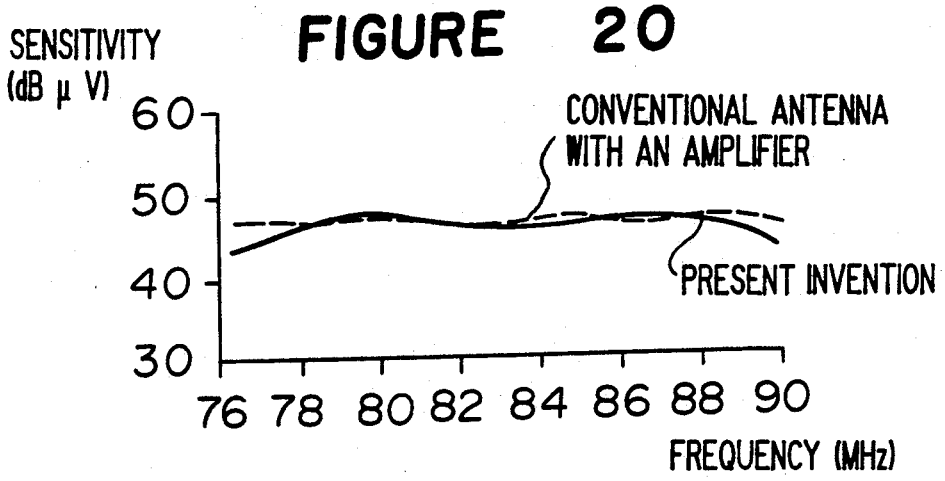
FIG. 20 is a frequency characteristic diagram in an FM broadcast frequency band region of the antenna device of the first example.
Figure 21:
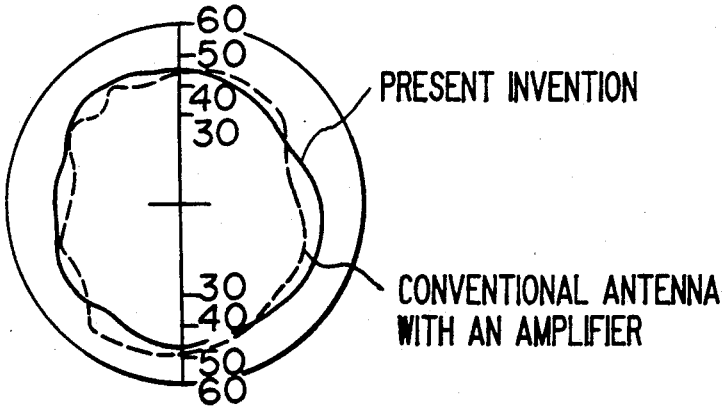
FIG. 21 is a diagram showing the directivity of FM broadcast frequency band region of the antenna device of the first example.
Figure 22:
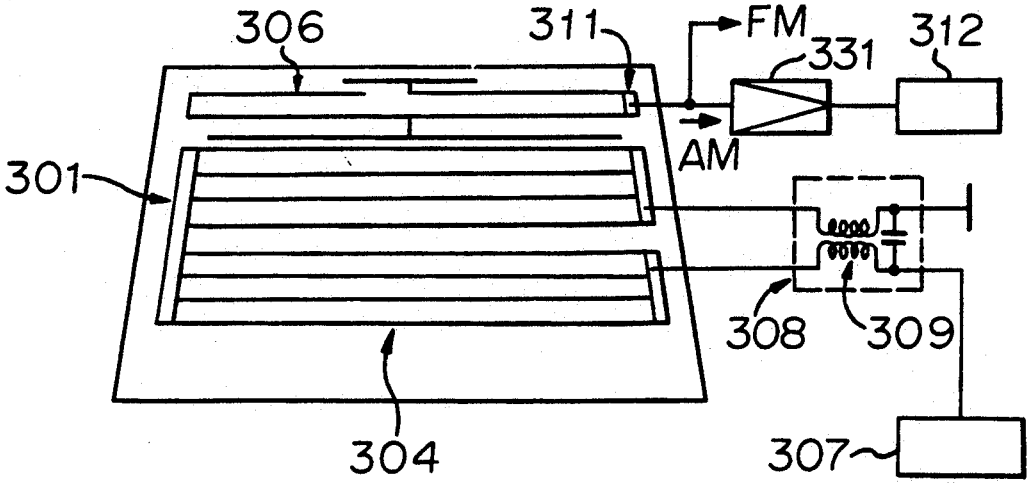
FIG. 22 is a diagram showing a conventional antenna device for an automobile.

When a capacitor 219 of 0.01 μF, a coil 218 of 2 μH, coils 212a, 212b of each 2 μH and an antenna cable portion of 30 pF/m extended between a power feeding point 204 of the antenna conductor 6 and the input terminal of the receiver 220 are respectively used as elements effectively functioning in FM radio broadcast frequency band regions, the characteristics of antenna gain and directivity of the antenna device in the FM frequency band regions are shown in FIGS. 20 and 21. The antenna device is also applicable to an antenna device for FM radio waves of a high gain and of non-directivity.

The quality factor Q in combination of the impedance of the heater strips 2 viewed from the bus bars 3a, 3b and the reactance circuit in the antenna device was 0.1 for AM radio waves and 0.5 for FM radio waves. The sum of the impedance of the antenna conductor viewed from the input terminal of the receiver and elements functioning as an antenna was 0.2 for AM and 0.4 for FM.

In accordance with the present inventions, an antenna device for an automobile having high radio wave receiving performance and obtaining a high gain at a low noise level without using a pre-amplifier can be provided. In particular, it is useful for receiving AM radio waves with a high gain and a low noise level. Further, it is applicable to receive FM radio waves and other radio waves. The manufacturing cost can be reduced by omitting the pre-amplifier. In the past, it was necessary to place the pre-amplifier near the antenna device, which restricts conditions of designing an automobile. In accordance with the present invention, however, such restriction can be eliminated because a simple matching circuit is only needed.

In accordance with the antenna device for an automobile of the present invention, FM radio waves can be received with excellent directivity. The reactance two-terminal network circuit is a matching circuit having a simple circuit. Accordingly, it is seldom to cause reflection and reverse flow at structural elements in comparison with the conventional glass antenna having a pre-amplifier, hence it is seldom to cause the disturbance of the waveform of an electric signal entering in the radio wave receiver. This results in increasing the reproductivity of the radio waves entering in the receiver, and excellent stable radio wave-receiving performance can be obtained.

The antenna device of the present invention can receive AM radio waves at a low noise level and it is also suitable not only to an antenna device for FM radio waves but also for AM/FM radio waves for an automobile. The reactance two-terminal network circuit used for the present invention provides a high noise suppressing effect in comparison with a four-terminal network circuit. Further, it provides sufficient matching effect.

In addition, it does not require the pre amplifier needed for the conventional antenna device, and it can be realized by using a simple reactance two-terminal network circuit. Accordingly, the manufacturing cost can be reduced and the fitting operation to an automobile and maintenance works can be easy. The configuration of the antenna device can be compact to thereby provide flexibility in designing an automobile. Further, since the antenna device is constituted by reactance elements, it is unnecessary to provide a d.c. power source for a pre-amplifier, and therefore the manufacturing cost can be remarkably reduced.

We claim:

1. An antenna device for an automobile comprising an electric heating type defogger having heating strips and a bus bar for feeding a current to the heating strips and an antenna conductor having at least one antenna strip arranged to form a pattern, said defogger and said antenna conductor being one of in and on a rear window glass fitted to a rear window opening formed in an automobile, characterized in that said defogger and said antenna conductor are spaced apart from each other with a predetermined small space in a capacitive coupling relation so that a high frequency current is caused to flow but a direct current is not caused to flow between them; a reactance circuit is connected to said defogger to effect anti-resonance between said defogger and said rear window opening of the body of the automobile at a central frequency in terms of logarithmic scale of a broadcast frequency band region; a quality factor value is determined from the inductance of a choke coil in said reactance circuit and a stray capacity between said defogger and said rear window opening of the body of the automobile so that the ratio of the impedance of an input to a receiver to the impedance of said antenna conductor viewed from the side of a power feeding terminal is 1; and a matching circuit is inserted between said power feeding terminal of the antenna conductor and said receiver so that the sum of the impedance of said antenna conductor viewed from the side of the input terminal of said receiver and a functional part as an antenna in said rear window glass exhibits a capacitive reactance in a broadcast frequency band region.

2. The antenna device for an automobile according to claim 1, wherein said choke coil is used for the reactance circuit connected to said defogger, and an anti-resonance frequency provided by the inductance of said coil and a stray capacity between said coil and the rear window opening of the body of the automobile is determined to be the center in terms of logarithmic scale of a broadcast frequency band region.

3. The antenna device for an automobile according to claim 1, wherein said matching circuit inserted between said power feeding terminal of the antenna conductor and said receiver is constituted by a reactance two-terminal network circuit in a combination of at least one coil capacitors and resistors wherein the impedance of said matching circuit is substantially constant in the entire region of a broadcast frequency band region, and the sum of the impedance of said antenna conductor viewed from the input terminal of the receiver, the functional part as an antenna in said rear window glass and a part of an antenna feeder line in a broadcast frequency band region exhibits a capacitive reactance.

4. An antenna device for an automobile comprising an electric heating type defogger having heating strips and a bus bar for feeding a current to the heating strips and an antenna conductor having at least one antenna strip arranged to form a pattern, said defogger and said antenna conductor being one of in and on a rear window glass fitted to a rear window opening formed in an automobile, characterized in that said defogger and said antenna conductor are spaced apart from each other with a predetermined small space in a capacitive coupling relation so that a high frequency current is caused to flow but a direct current is not caused to flow between them; a reactance circuit is connected to said defogger to effect anti-resonance between said defogger and said rear window opening of the automobile at a central frequency in terms of logarithmic scale of a broadcast frequency band region; and a reactance two-terminal network circuit is connected between a power feeding point for said antenna conductor and a radio wave receiver wherein the impedance of said reactance two-terminal network circuit is of a nature of inductive reactance and has a constant value in the entire area of FM radio carrier wave frequency.

5. The antenna device for an automobile according to claim 4, wherein the absolute value of the impedance of the reactance two-terminal network circuit is in a range of 70Ω–130Ω in the entire region of FM radio carrier wave frequency, and the phase angle is in a range of +65°–+85°.

6. The antenna device for an automobile according to claim 4, wherein the length of the rear window opening in the horizontal direction is at least 1.7 times as the length of the same in the longitudinal direction.

7. An antenna device for an automobile comprising an electric heating type defogger having heating strips and a bus bar for feeding a current to the heating strips and an antenna conductor having at least one antenna strip arranged to form a pattern, said defogger and said antenna conductor being one of in and on a rear window glass fitted to a rear window opening formed in an automobile, characterized in that said defogger and said antenna conductor are spaced apart from each other with a predetermined small space in a capacitive coupling relation so that a high frequency current is caused to flow but a direct current is not caused to flow between them; a reactance circuit is inserted between a bus bar of the defogger and a d.c. power source for said defogger so that anti-resonance is effected, at a band region on a side of a central frequency in terms of a logarithmic scale of each FM or AM broadcast frequency band region, between the impedance of said reactance circuit and the impedance of an electric static capacitance, viewed from the connecting part of lead wires of said bus bar, in said antenna conductor, said defogger and the body of the automobile, wherein a quality factor value for the AM broadcast frequency band region is determined to be $Q \leqq 1.2$ and a quality factor value for the FM broadcast frequency band region is to be $Q \leqq 2.4$ whereby the resonance characteristic of the quality factor for effecting the anti-resonance becomes relatively flat; and a matching circuit is inserted between the power feeding point of said antenna conductor and a receiver so that resonance is effected, at the band region of the other side of the central frequency of each of the FM or AM broadcast frequency band regions, between the impedance of said matching circuit and the impedance of input of said receiver and the antenna conductor viewed from said matching circuit, wherein a quality factor for the AM broadcast frequency band region is determined to be $Q \leqq 1.2$ and a quality factor for the FM broadcast frequency band region is to be $Q \leqq 2.4$ whereby the resonance characteristic of the quality factor for effecting the resonance becomes relatively flat.

8. The antenna device for an automobile according to claim 7, wherein said one side of the central frequency in terms of logarithmic scale of the FM and AM frequency band regions is a low frequency band region, and the other side is a high frequency band region.

9. The antenna device for an automobile according to claim 7, wherein said reactance circuit connected to said defogger comprises a heater transformer having a toroidal core of a magnetic substance which has a high magnetic permeability in the AM broadcast frequency band region, wherein one terminal of said heater transformer is connected to two-split bus bars of said defogger and the other terminal is connected to a d.c. power source, and a high frequency coil operable in the FM broadcast frequency band region without residual magnetism which is inserted between said d.c. power source and said heater transformer, wherein the negative pole of said d.c. power source is connected to the body of the automobile at a position at least 30 cm apart from the negative pole of a cable.

* * * * *